US008517235B1

(12) United States Patent
Kincaid et al.

(10) Patent No.: US 8,517,235 B1
(45) **Date of Patent: *Aug. 27, 2013**

(54) HOLSTER WITH HOOD ASSEMBLY

(75) Inventors: Robert A. Kincaid, Bozeman, MT (US); Thomas M. Gregory, Belgrade, MT (US); Eric M. Yeates, Virginia Beach, VA (US); Clifton L. Cook, Sheridan, WY (US); Charles E. Buis, III, Virginia Beach, VA (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/446,273

(22) Filed: Apr. 13, 2012

Related U.S. Application Data

(63) Continuation of application No. 12/231,476, filed on Sep. 3, 2008, now Pat. No. 8,177,108, which is a continuation-in-part of application No. 10/888,047, filed on Jul. 9, 2004, now Pat. No. 7,434,712.

(51) Int. Cl.
*F41C 33/02* (2006.01)

(52) U.S. Cl.
USPC ..... 224/243; 224/193

(58) Field of Classification Search
USPC ..... 224/192, 193, 196, 198, 238, 243, 224/912
See application file for complete search history.

(56) References Cited

U.S. PATENT DOCUMENTS

| | | | | |
|---|---|---|---|---|
| 4,318,503 | A | 3/1982 | Capano | |
| 4,408,706 | A | 10/1983 | Hurley | |
| D294,086 | S | 2/1988 | Nichols | |
| 4,865,238 | A | 9/1989 | Bianchi | |
| 4,912,867 | A | 4/1990 | Dukes, Jr. | |
| 5,284,281 | A | 2/1994 | Nichols | |
| 5,358,160 | A | 10/1994 | Bianchi | |
| 5,419,474 | A | 5/1995 | Marx et al. | |
| 5,501,381 | A | 3/1996 | Rogers et al. | |
| 5,518,155 | A | 5/1996 | Gallagher | |
| 5,570,830 | A | 11/1996 | Nichols | |
| 5,573,157 | A | 11/1996 | Mauriello et al. | |
| 5,622,297 | A | 4/1997 | Rogers et al. | |
| 5,630,535 | A | 5/1997 | Valenti | |
| 5,810,221 | A | 9/1998 | Beletsky et al. | |
| 5,855,305 | A | 1/1999 | Nichols | |
| 5,918,784 | A | 7/1999 | Serpa | |
| 5,944,239 | A | 8/1999 | Rogers et al. | |
| 6,085,951 | A | 7/2000 | Beletsky et al. | |
| 6,112,962 | A | 9/2000 | Matthews | |
| 6,371,341 | B1 | 4/2002 | Clifton, Jr. | |
| 6,467,660 | B1 | 10/2002 | Rogers et al. | |
| 7,819,294 | B2 * | 10/2010 | Lowe et al. | 224/243 |

(Continued)

*Primary Examiner* — Justin Larson

(74) *Attorney, Agent, or Firm* — Wooten & Shaddock, PLC

(57) ABSTRACT

A holster having a body defining a cavity for receiving at least a portion of a weapon, the body comprising a pair of opposed side walls; a hood assembly pivotably connected to the body, wherein the hood assembly is pivotable between an open position and a closed position; a lock mechanism for maintaining the hood assembly in the closed position; a finger/thumb release associated with the lock mechanism for releasing the hood assembly from the closed position; and at least one pivot arm that extends from the hood assembly to a pivot plate, wherein the pivot plate automatically pivots the hood assembly to the closed position such that to the lock mechanism is automatically engaged as a forward face of a trigger guard of an inserted weapon urges the pivot plate.

19 Claims, 15 Drawing Sheets

(56) References Cited

U.S. PATENT DOCUMENTS

| | | | |
|---|---|---|---|
| 2002/0017541 | A1 | 2/2002 | French |
| 2002/0134803 | A1 | 9/2002 | Lowe et al. |
| 2002/0153396 | A1 | 10/2002 | French et al. |
| 2004/0050887 | A1 | 3/2004 | Spielberger |
| 2005/0035163 | A1 | 2/2005 | French et al. |
| 2005/0205621 | A1 | 9/2005 | Shults |

* cited by examiner

FIG. 3B
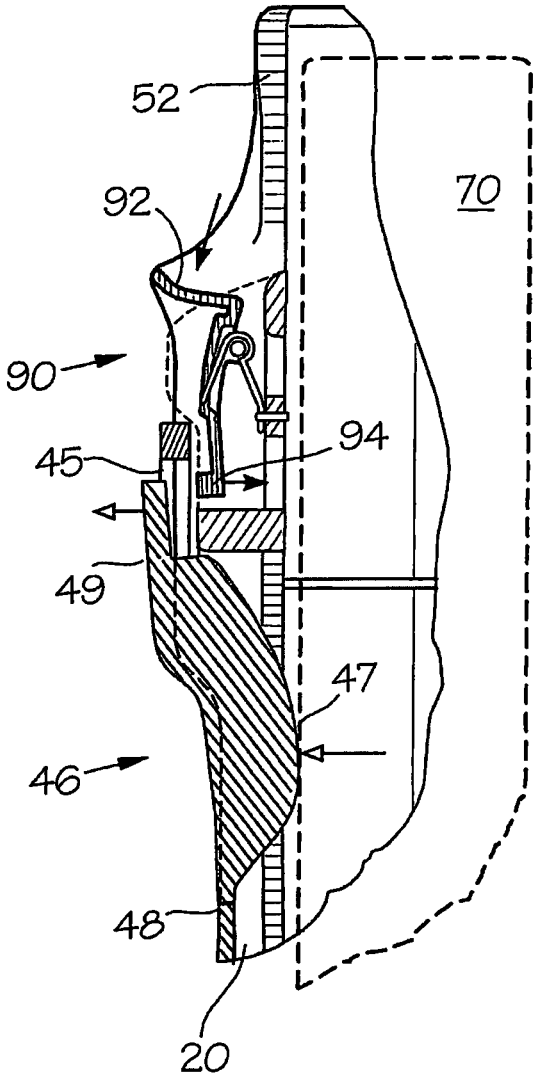
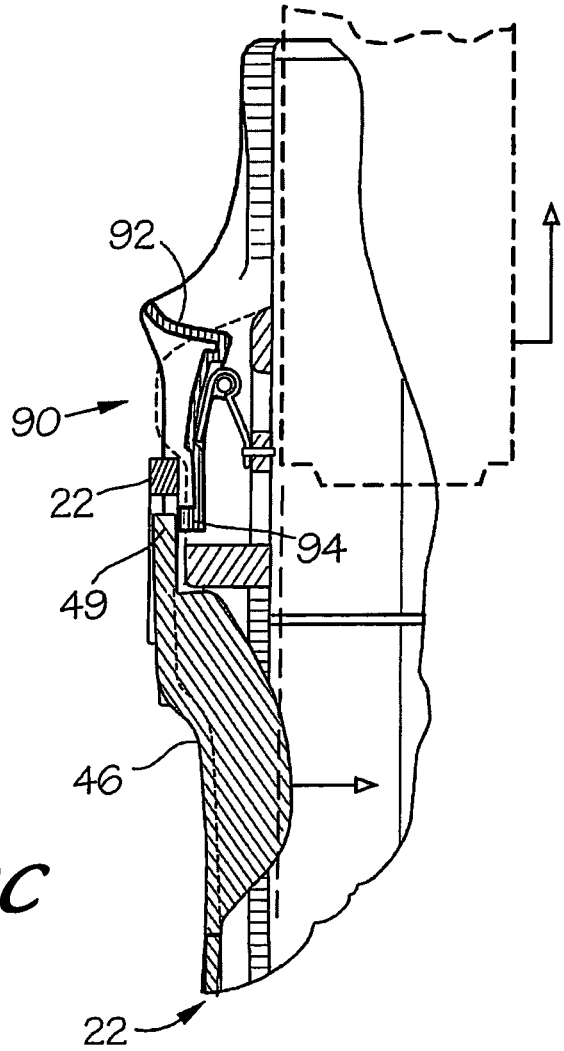
FIG. 3C

FIG. 4A
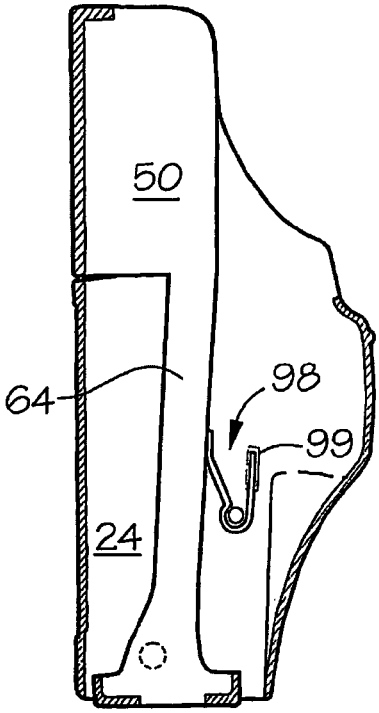
FIG. 4B
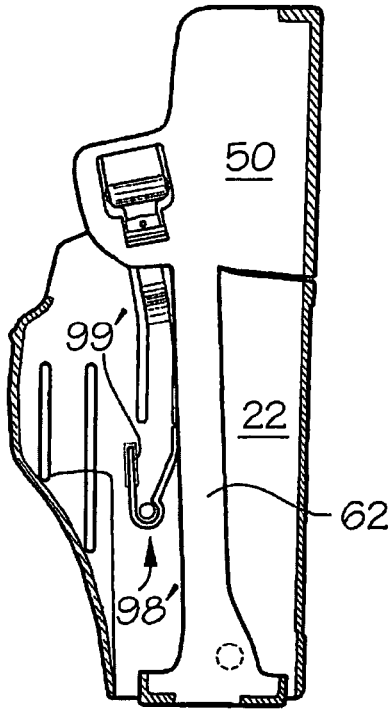
FIG. 4C
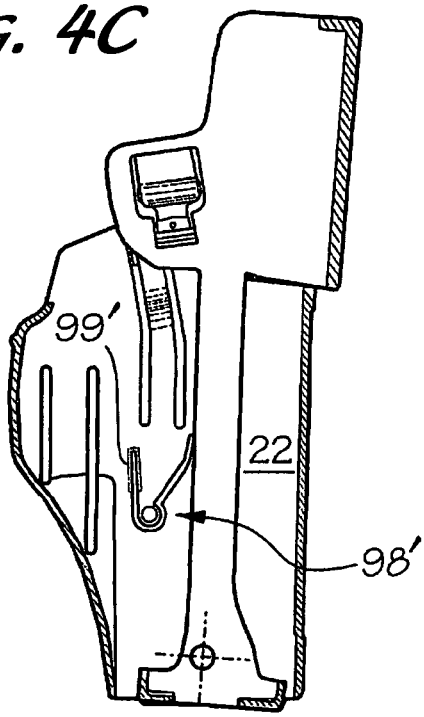
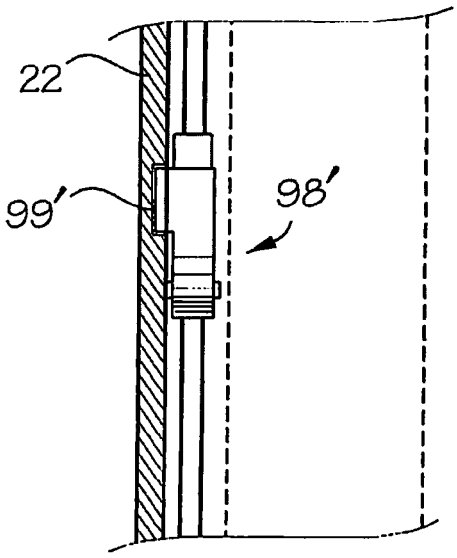
FIG. 4D

FIG. 12A
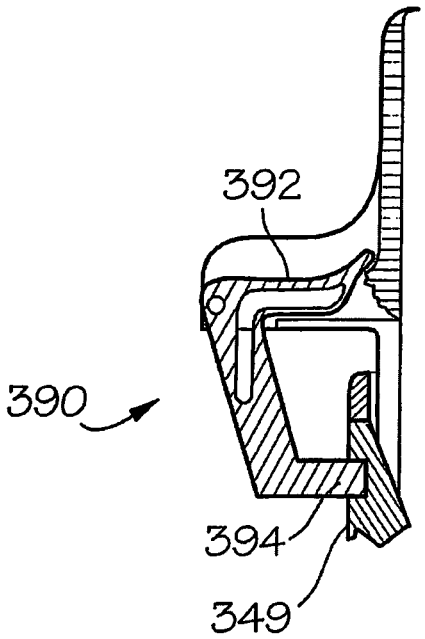
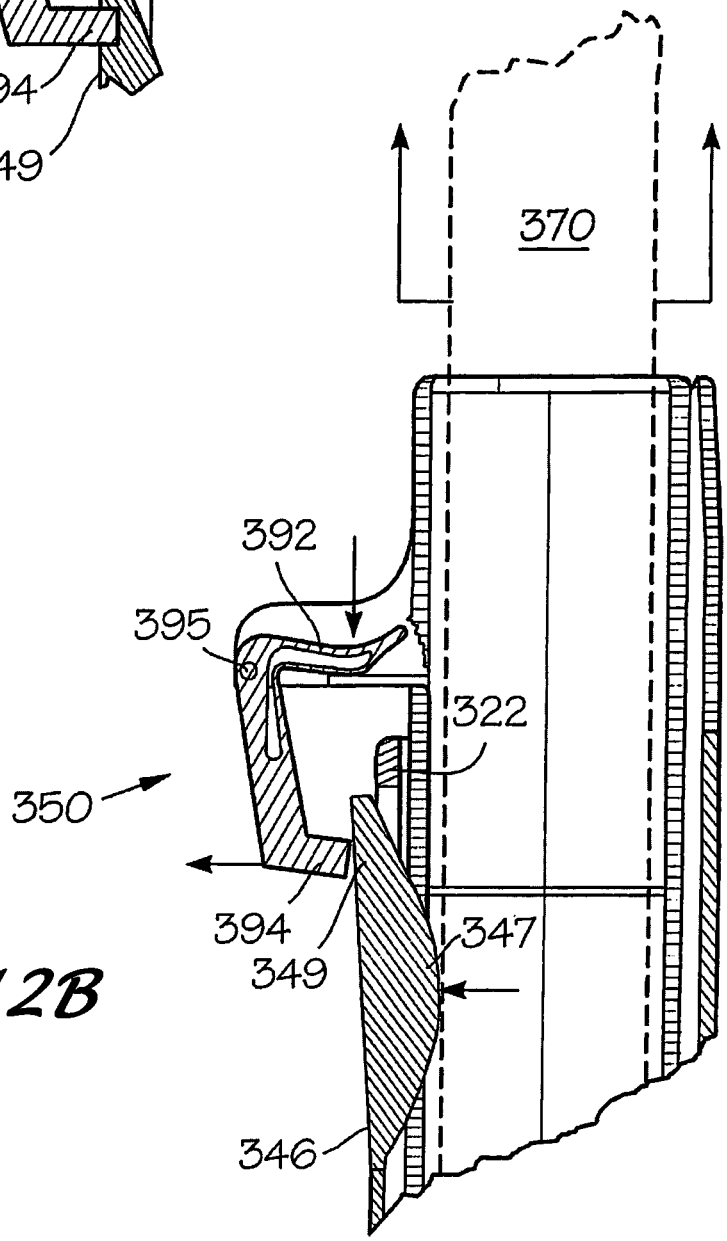
FIG. 12B

HOLSTER WITH HOOD ASSEMBLY

CROSS-REFERENCE TO RELATED APPLICATIONS

This is a Continuation of U.S. patent application Ser. No. 12/231,476, filed Sep. 3, 2008, which issued on May 15, 2012 as U.S. Pat. No. 8,177,108, which is a Continuation-In-Part of U.S. patent application Ser. No. 10/888,047, filed Jul. 9, 2004, and issued as U.S. Pat. No. 7,434,712, the disclosures of which are incorporated herein by reference in their entireties.

BACKGROUND OF THE INVENTION

1. Field of the Invention

This invention is directed generally to a holster for a weapon such as a handgun. More specifically, the present invention relates to a holster of the type that precludes unintended removal of the weapon.

2. Description of Related Art

The present invention relates generally to a rigid holster for a weapon. More particularly, the invention relates to a holster that includes a hood for securing a weapon such that it may be easily removed from the holster by the wearer but removal by those other than the wearer is very difficult.

Previously, many holsters have been constructed with a strap for securing a weapon such as a handgun. Typically, the strap is looped across a hammer or other such part of the gun and includes a snap fastener at one end. The snap fastener is disengaged to remove the weapon from the holster.

This configuration is dependable for securing the weapon. However, a major problem with the existing prior art is that a criminal or adversary can easily remove the weapon from the holster during a struggle. That is to say, another person can easily disengage the snap fastener and remove the weapon from the holster.

At least one prior art holster addressed this drawback by providing an overlying hood or strap assembly which is readily released by a thumb activated mechanism. Any possible assailant must first determine the means for engaging the mechanism and then use two hands in order to spring the strap forward and free the weapon. However, while the weapon is easily drawn by the user, upon reholstering the weapon the user must manually reposition the strap.

The present invention solves the aforementioned problem by automatically locking the weapon in place with a releasable mechanism that is easily operated by a wearer of the holster. However, the present mechanism is not easily disengaged by anyone other than the wearer.

Another prior art holster provides a means for securing a handgun which is automatically engaged upon insertion of the handgun into the holster. Such holster relies on a retention pin, which automatically engages the trigger guard of the handgun upon holstering. The pin is released upon engagement of a release lever on the outer surface of the holster. Although such prior art holster provides an excellent means for securing and drawing a weapon, room exists in the art for further holster improvements, including additional or alternate points of security.

By means of the present invention, a holster is configured to include an automatically locking hood mechanism that secures a weapon within the holster. A release lever must be engaged in order to unlock and pivot the hood to an open position such that the weapon may be removed.

SUMMARY OF THE INVENTION

Accordingly, the present invention is directed to a holster for a weapon, which includes a body defining a cavity for receiving and holding a weapon, the body having a pair of opposed side walls, a front wall, a rear wall, and a lower portion, a hood assembly pivotably connected to the body, the hood assembly pivotable between a closed position for securing the weapon within the body cavity and an open position for removal of the weapon, a lock mechanism maintaining the hood assembly in the closed position when a weapon is held in the body cavity, a finger/thumb release associated with the lock mechanism for releasing the hood assembly to the open position for removal of the weapon, and means for automatically pivoting the hood assembly to the closed position and thereby automatically engaging the lock mechanism upon insertion of the weapon into the body cavity, wherein the lock mechanism is biased to an engaged position when the weapon is held in the body cavity. In various exemplary embodiments, the finger/thumb release is a thumb release.

In various exemplary embodiments, the hood assembly is biased to the open position when a weapon is absent from the body. Such may be accomplished by, for example, a spring.

It is also preferred that the lock mechanism is precluded from engaging when a weapon is absent from the body.

In one embodiment, the weapon includes an attached accessory and a portion of the body of the holster includes a removable, replaceable, interchangeable cup. For such embodiment, the holster further includes at least one replacement cup for accommodating the attached accessory on the weapon.

The hood assembly of the present holster preferably includes a retaining hood, at least one elongated pivot arm, and a pivot plate. Thus, the hood assembly is pivotably attached at a point on the pivot arm adjacent to the pivot plate to a point on the body adjacent to the lower portion of the body. In various exemplary embodiments, the hood assembly includes a pair of elongated pivot arms, wherein the pivot arms and pivot plate are positioned within the body cavity, the pivot arms extended along the interior of the opposed side walls and the pivot plate positioned at the lower portion of the body. For such preferred embodiment, the hood assembly is pivotably attached at coplanar points on the pivot arms adjacent to the pivot plate to coplanar points on the body adjacent to the lower portion of the body. Thus, the means for automatically pivoting the hood assembly to the closed position involves engagement of a surface of the weapon, such as, for example a forward face of the weapon or a forward face of the weapon's trigger guard, with the pivot plate of the hood assembly.

In various exemplary embodiments, the holster is rigid and is securable onto a belt, webbing, or platform.

Accordingly, this invention provides a holster of improved design.

This invention separately provides a holster, having an improved securing mechanism.

This invention separately provides a holster having a retention system, which is simple to operate.

This invention separately provides a holster having a retention system, which automatically secures the handgun in the holster upon seating of the handgun in the holster, without requiring any additional operation by the user.

These and other features and advantages of this invention are described in or are apparent from the following detailed description of the exemplary, nonlimiting embodiments.

BRIEF DESCRIPTION OF THE DRAWINGS

The exemplary embodiments of this invention will be described in detail, with reference to the following figures, wherein like reference numerals refer to like parts throughout the several views, and wherein:

FIG. 3B is a sectional view of the holster of FIG. 3A showing disengagement of the locking mechanism immediately prior to unholstering the weapon (shown in phantom);

FIG. 3C is a sectional view of the holster of FIG. 3A showing the inability of the lock mechanism to engage immediately upon unholstering of the weapon (shown in phantom);

FIG. 4A is side, cross-sectional elevation view of a holster in accordance with the present invention showing the positioning of a spring-loaded mechanism for biasing the hood assembly into the open position upon removal of a weapon;

FIG. 4B is a side, cross-sectional elevation view of the holster of FIG. 4A taken from the other side;

FIG. 4C is a side, cross-sectional elevation view of the holster of FIG. 4B with the hood assembly biased to the open position; and FIG. 4D is a rear, cross-sectional elevation view of the spring positioning shown in FIG. 4A.

FIG. 12A is a close-up, rear cross-sectional view of the lock mechanism shown in FIG. 11;

FIG. 12B is a rear cross-sectional view of the lock mechanism shown in FIG. 11 upon unholstering of a weapon, shown in phantom;

DETAILED DESCRIPTION OF EXEMPLARY EMBODIMENTS

Figure 1A:
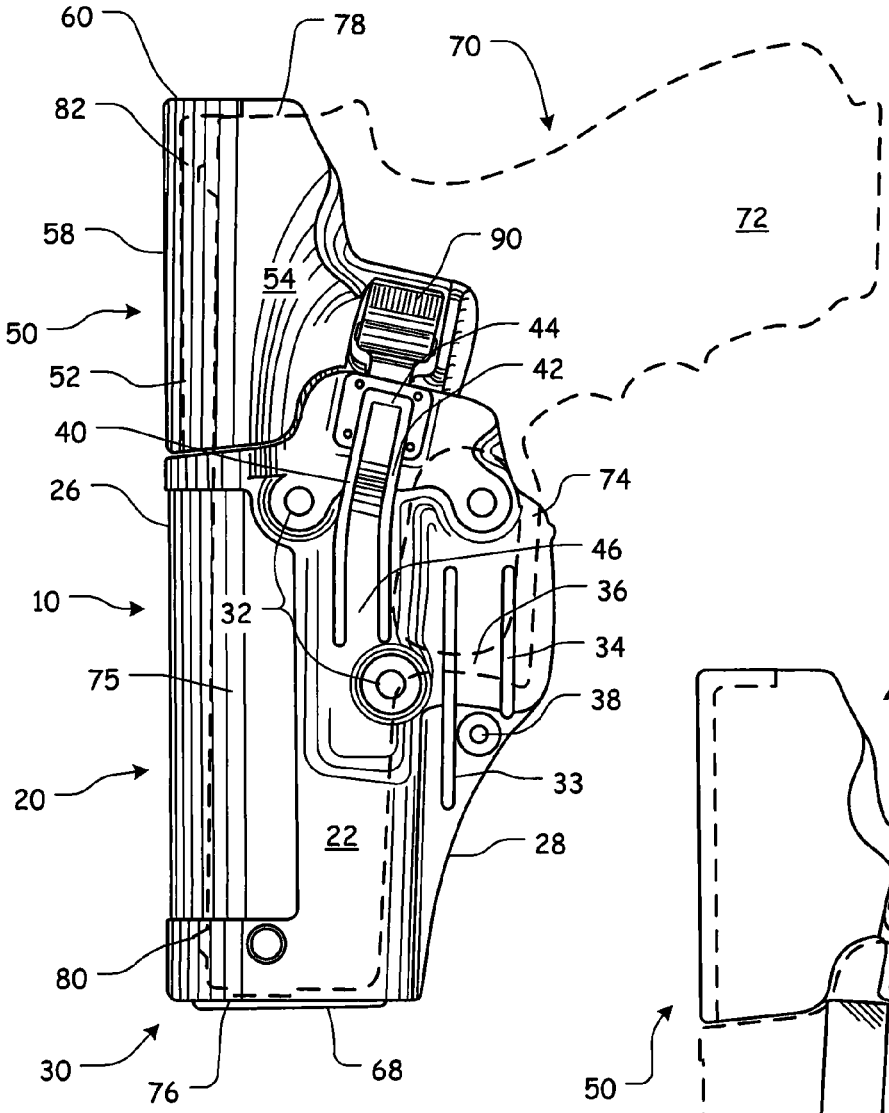
FIG. 1A is an elevational side view of the present inventive holster showing a weapon in phantom.

For simplicity and clarification, the design factors and operating principles of the holster according to this invention are explained with reference to various exemplary embodiments of a holster. The basic explanation of the design factors and operating principles of the holster is applicable for the understanding, design, and operation of the holster of this invention.

It should be appreciated that, for simplicity and clarification, the embodiments of this invention will be described with reference to a semiautomatic-type handgun being secured within the present holster. However, it should be appreciated that the operating principles of the holster of this invention may also be employed to construct holsters for any revolver or semiautomatic-type handgun, edged weapons as well as less than lethal products (i.e., tasers, pepper spray, mace canisters, or batons), so long as these items have an appropriate ledge or surface that may be engaged or contacted by a portion of an appropriate pivot plate. Furthermore, it is also within the scope of the present invention that the present holster may be employed as a holder or pouch for tactical accessories, such as ammunition magazines and/or flashlights, as well as for everyday items such as cell phones or personal digital assistants.

It should also be appreciated that the terms "handgun", "holster", and "weapon" are used for basic explanation and understanding of the operation of the systems, methods, and apparatuses of this invention. Therefore, the terms "handgun", "holster", and "weapon" are not to be construed as limiting the systems, methods, and apparatuses of this invention.

The present invention is directed to a holster that includes a body for receiving a weapon, a hood assembly for securing the weapon within the body, a lock mechanism for maintaining the hood assembly in a closed, weapon securing position, a finger/thumb release for disengaging the lock mechanism and allowing the hood assembly to pivot to an open position for removal of the weapon, and means for automatically closing the hood assembly and engaging the lock mechanism when the weapon is reinserted, wherein the lock mechanism is in an engaged position while a weapon is held in the holster. In various exemplary embodiments, the hood assembly is biased to an open position a weapon is absent from the holster.

In various exemplary embodiments, the present inventive holster is substantially rigid and may be formed of a polymeric material such as a polymeric composite. Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, glass or polymer fiber reinforced plastics, and/or various combinations of the foregoing.

In various exemplary embodiments, at least certain components of the holster may be formed of any known or later developed, substantially flexible material(s) such as a polymeric material, leather, foam, foam laminates, natural and man-made (synthetic) fabrics, natural and man-made (synthetic) fabric laminates, moldable honeycomb materials, or the like, and/or various combinations of the foregoing.

Thus, it should be understood that the material or materials used to form the holster and/or various components of the holster is a design choice based on the desired appearance and functionality of the holster.

The weapon that is secured within the present holster may be a handgun. However, the present holster may also be employed for edged weapons as well as less than lethal products i.e., tasers, pepper spray, mace canisters or batons. Further, it is also within the scope of the present invention that the present holster may be employed as a pouch for tactical accessories, such as magazines and/or flashlights, as well as for everyday items such as cell phones and personal digital assistants.

Turning now to the drawing figures, FIG. 1A shows a holster 10 in accordance with the present invention having a body 20 and a hood assembly 50. A handgun 70 is shown in phantom. As shown in FIG. 1A, handgun 70 includes a grip 72, trigger guard 74, barrel 75, front face 76, rear face 78, front sight 80, and rear sight 82. The body 20 of the holster defines a weapon-receiving cavity and includes a first side wall 22, a second side wall (not visible in this view), a front wall 26, a rear wall 28, and a lower portion 30. It should be noted that the walls of the holster body generally are not planar but rather are contoured and shaped in order to accommodate the weapon such as handgun 70.

Attachment points 32 provide means for fastening the holster to a holster holding device such as that described in U.S. Pat. No. 7,320,420, issued Jan. 22, 2008. Alternatively, the holster 10 can comprise a clip or hook adapted to be clipped over a belt. In a further alternate embodiment, one or more quick-disconnect couplings can be provided on or adjacent side wall 22 of the holster 10, and cooperating coupling(s) provided on a belt or on a carrier worn on a belt. Provision of quick-disconnect couplings advantageously permits the user to remove the holster for comfort, for example during driving without removing the belt. In further alternate embodiments, the holster 10 can comprise an integral belt, or can comprise one or more connections for attachment to a chest or ankle harness, or a waistband; or for otherwise securing the holster to a user or the user's apparel. Typically, side wall 22 is considered the inside face of the holster and is worn against or adjacent the user's body.

One or both of the side walls include parallel grooves 33 and 34, which define retention plate 36. Although not shown in the present figures, the inner surface of plate 36 includes a raised area, which provides for frictional engagement of the trigger guard 74. Passive retention screw 38 may be tightened or loosened to adjust the degree of frictional retention of the handgun at this retention point.

Side wall 22 further includes grooves 40, 42, and 44, which define locking plate 46. The operation of the lock mechanism is described in detail below, specifically with reference to FIGS. 3A-3C and FIGS. 5A and 5B.

Hood assembly 50 includes retaining hood 52 having a first side wall 54, a second side wall (not visible in this view), a front wall 58, and a top wall 60. Thumb release 90 is positioned on side wall 54 and is an operable component of the lock, which is described in detail below. Also visible in this view is a portion of pivot plate 68 and pivot stud 66.

Figure 1B:
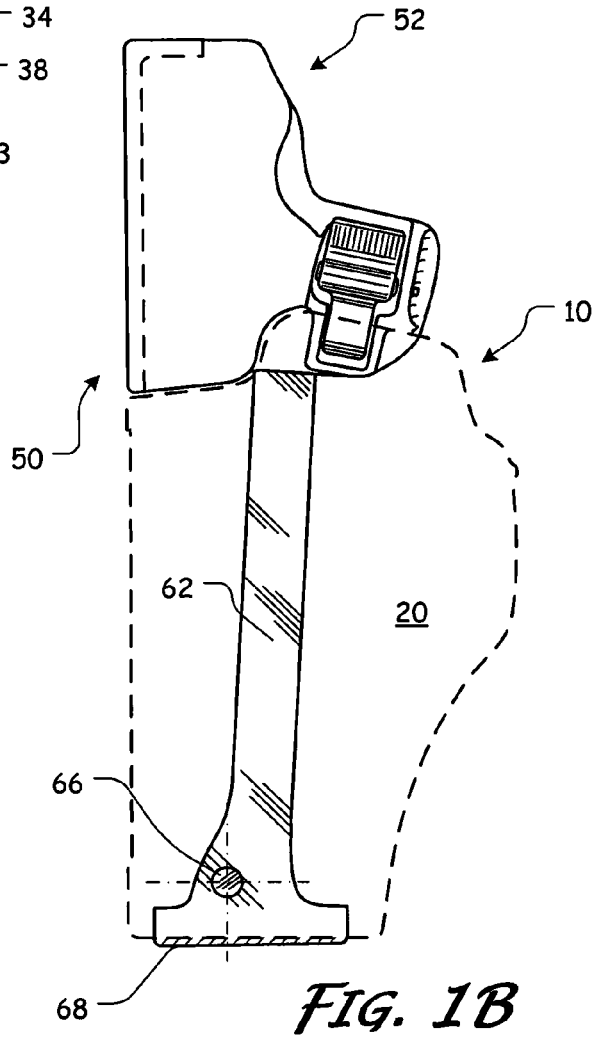
FIG. 1B is an elevational side view of the retaining hood, pivot arm, and pivot plate of the hood assembly, with the body of the holster in phantom.

FIG. 1B is a side elevation view of hood assembly 50 with holster body 20 in phantom and, thereby, more clearly showing the structure of the hood assembly 50 including retaining hood 52, elongated pivot arm 62, pivot stud 66, and pivot plate 68.

Figures 1C, 1D:
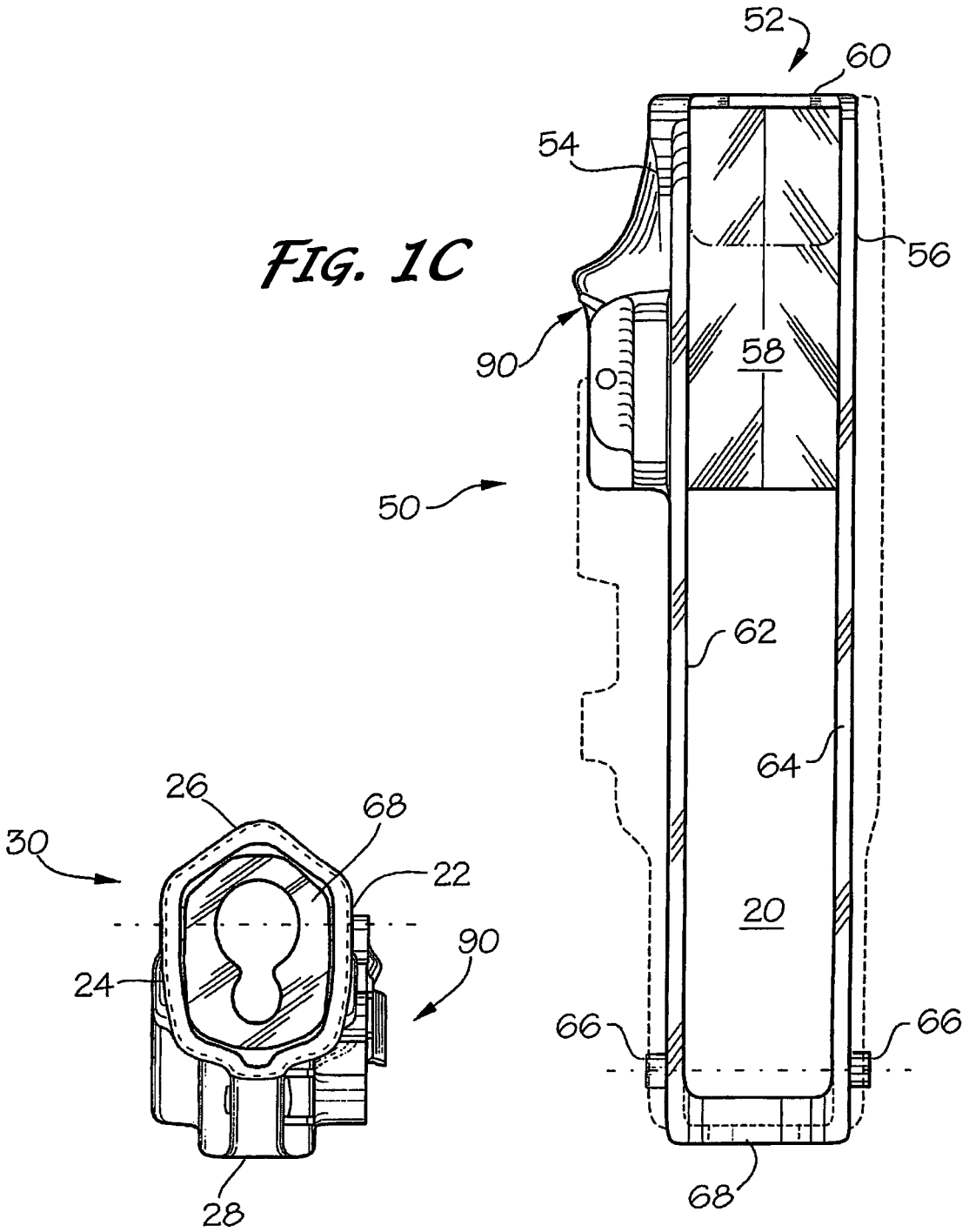
FIG. 1C is a front elevation view of the retaining hood, elongated pivot arms, and pivot plate of the hood assembly, showing the coplanar pivot studs extending outwardly from the arms adjacent to the pivot plate, with the body of the holster in phantom.
FIG. 1D is a bottom plan view of the holster of FIG. 1A.

The overall structure of the hood assembly 50 is further clarified by the front elevation view of FIG. 1C. Parallel, elongated pivot arms 62 and 64 extend from the retaining hood 52 to the pivot plate 68. In various exemplary embodiments, the elongated pivot arms 62 and 64 extend along the interior of the body side walls. Alternatively, the pivot aims 62 and/or 64 may extend within the interior of the body side walls or along the outside of the body side walls.

The holster body 20 as well as the pivot axis of the hood assembly is shown in phantom. The pivot studs 66 extend outwardly from the pivot arms at coplanar points adjacent to the pivot plate. They are received by coplanar holes or recesses defined in the side walls of the body, not shown in this view, which are adjacent to the lower portion of the body. It should be noted that the pivotable motion of the hood assembly may be achieved by other means, such as studs extending inwardly from the inner surfaces of the body side walls received by holes or recesses defined in lower portions of the pivot arms. Alternatively, a pivot pin may extend through aligned holes defined in the body side walls and the pivot arms.

In various exemplary embodiments, only one elongated pivot arm 62 or 64 extends from the retaining hood 52 to the pivot plate 68.

A bottom plan view of the present holster is provided in FIG. 1D. Thus, it can be seen that the pivot plate 68 extends into the lower portion 30 of the holster body. It should be noted that, while the body includes, generally, side walls 22 and 24, a front wall 26 and a rear wall 28. In various exemplary embodiments, the body does not include a bottom wall at its lower portion 30. Instead, the pivot plate may serve as the bottom wall of the holster.

Figure 2A:
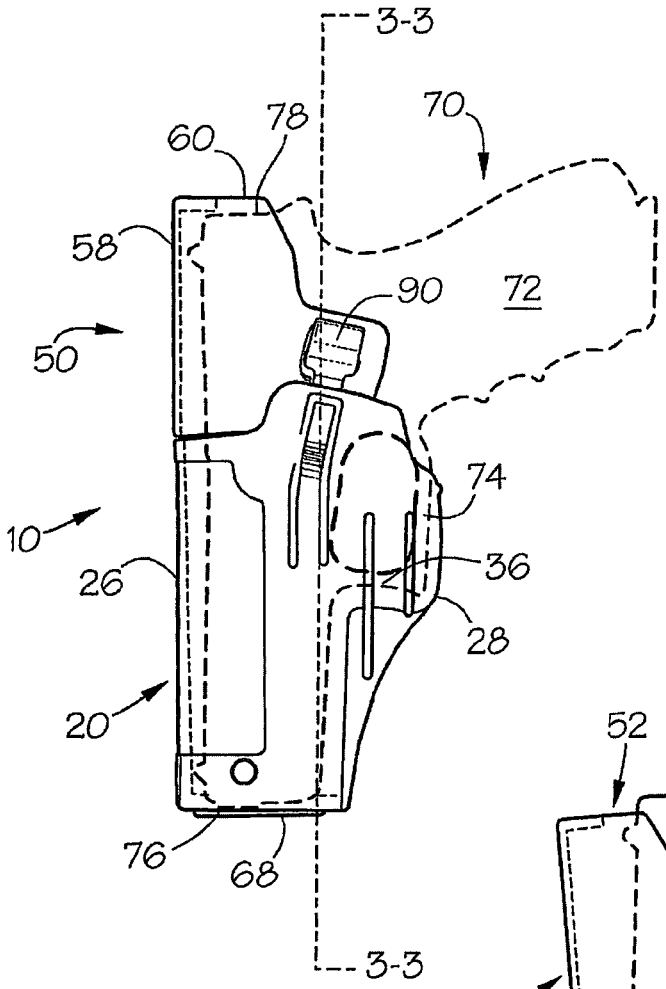
FIG. 2A is a simplified side elevation view of the holster of FIG. 1A, showing a weapon in phantom.

FIG. 2A-2D show the relative movement of the hood assembly as the gun is unholstered and reholstered. FIG. 2A is a side elevational view of holster 10, which shows the means by which handgun 70 is securely retained within the holster. The distance from the inside surface of the pivot plate 68 to the inside surface of the retaining hood top wall 60 specifically accommodates the length of the handgun 70 from its front face to its rear face. Similarly, the distance from the plane defined by the front wall 26 of the body and the front wall 58 of the retaining hood to the rear wall 28 of the body underlying the handgun's trigger guard 74 accommodates the height of the handgun from the lower surface of the trigger guard to the tops of the front and rear sights. As discussed above, retention plate 36 frictionally engages the trigger guard to keep the handgun firmly positioned within the holster.

Figure 2B:
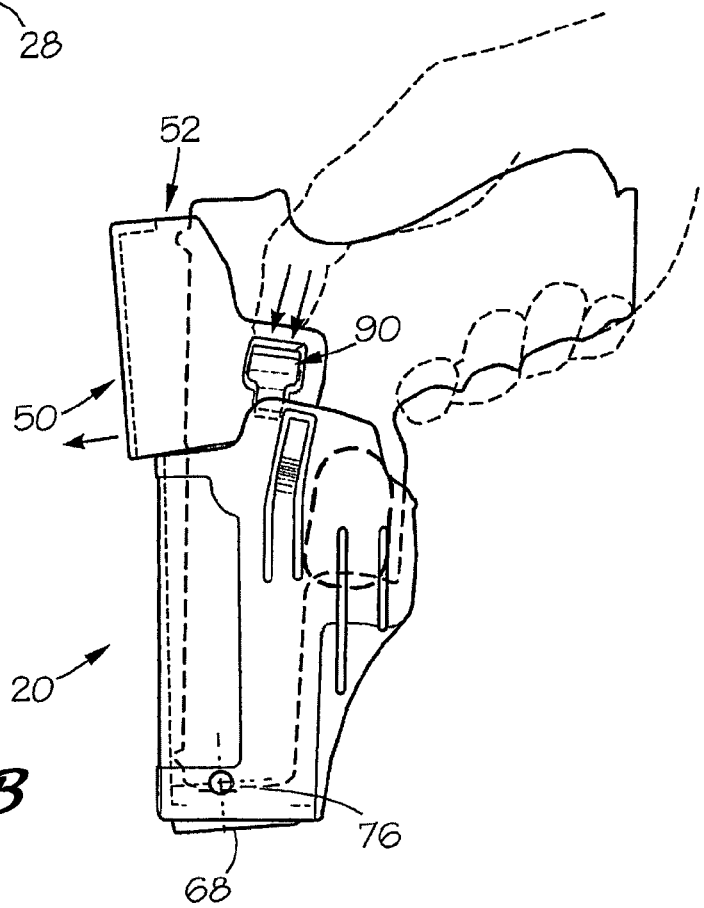
FIG. 2B is a side elevation view of the holster of FIG. 2A during unholstering of the weapon, including those portions of the weapon which are not visible and a user's hand in phantom.

The motion of unholstering the weapon is illustrated in FIG. 2B. The user grips the handgun and uses his thumb to release the lock mechanism by pressing thumb release 90. The figure shows the hood assembly pivoting toward an open position. In a preferred embodiment, the hood assembly is biased towards the open position when the lock mechanism is disengaged. Such bias may be achieved by a spring such as the spring shown in and discussed with respect FIGS. 4A-4D, below. Thus, when the user presses the thumb release 90, the retaining hood 52 automatically pivots open and the handgun is urged upwardly by the motion of the pivot plate 68 against the front face 76 of the handgun. The hood assembly is maintained in the open position until the user is ready to reholster the weapon.

Alternatively, the opening of the hood assembly may be achieved manually by the user such that an unholstering motion involves pressing the thumb release 90 and simultaneously pressing the retaining hood 52 forward. Once the weapon is removed, the hood assembly cannot be locked back into the closed configuration because the lock mechanism requires that a weapon is present in order to engage. Thus, for such embodiment which lacks biasing of the hood assembly to the open position, it is preferred that means is provided for holding the hood assembly in the fully opened position once it is reached in order to prevent movement or rattling of the hood assembly which cannot be closed.

Figure 2C:
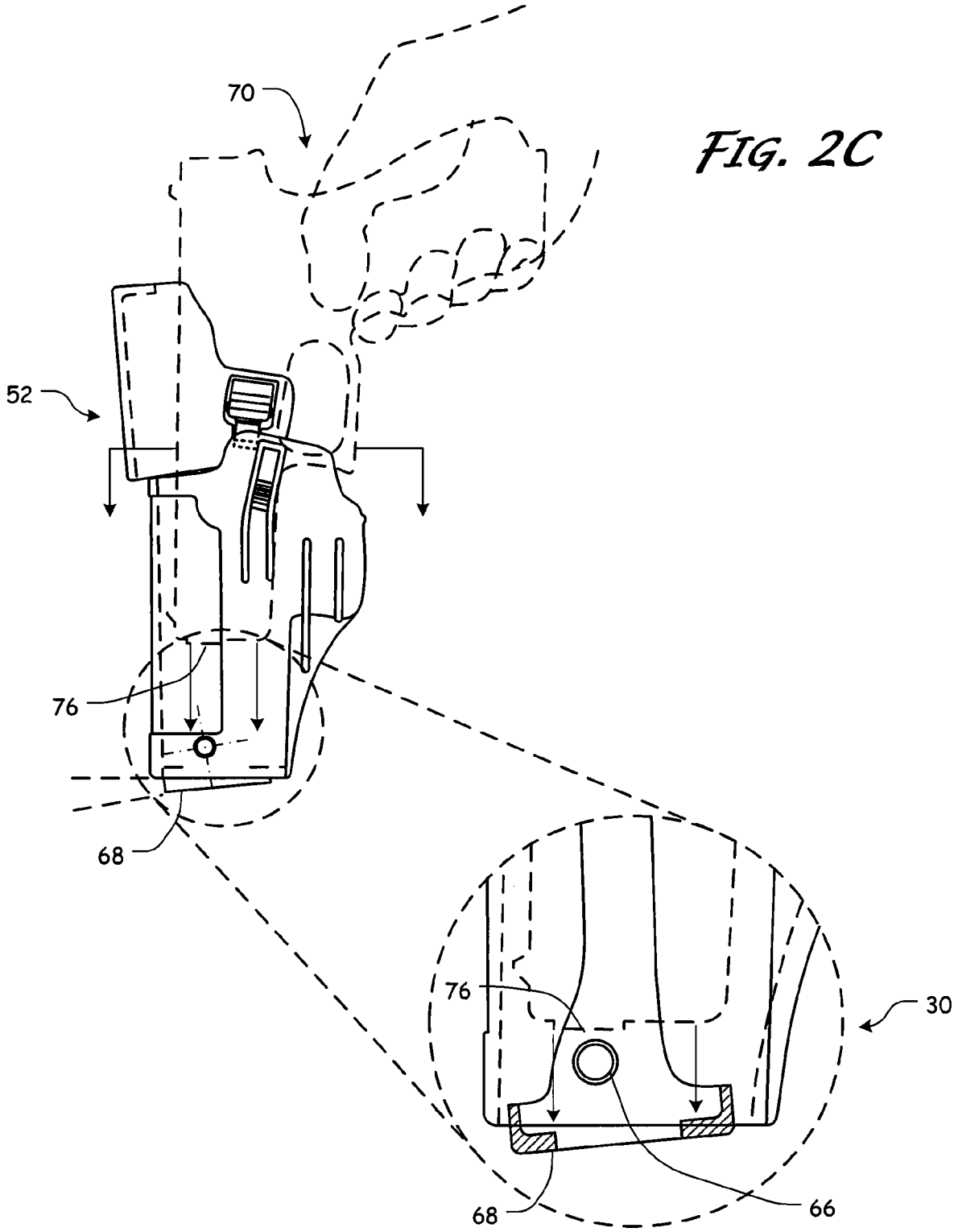
FIG. 2C is a side elevation view of the holster of FIG. 2A during holstering of the weapon, including those portions of the weapon which are not visible and a user's hand in phantom.
Figure 2D:
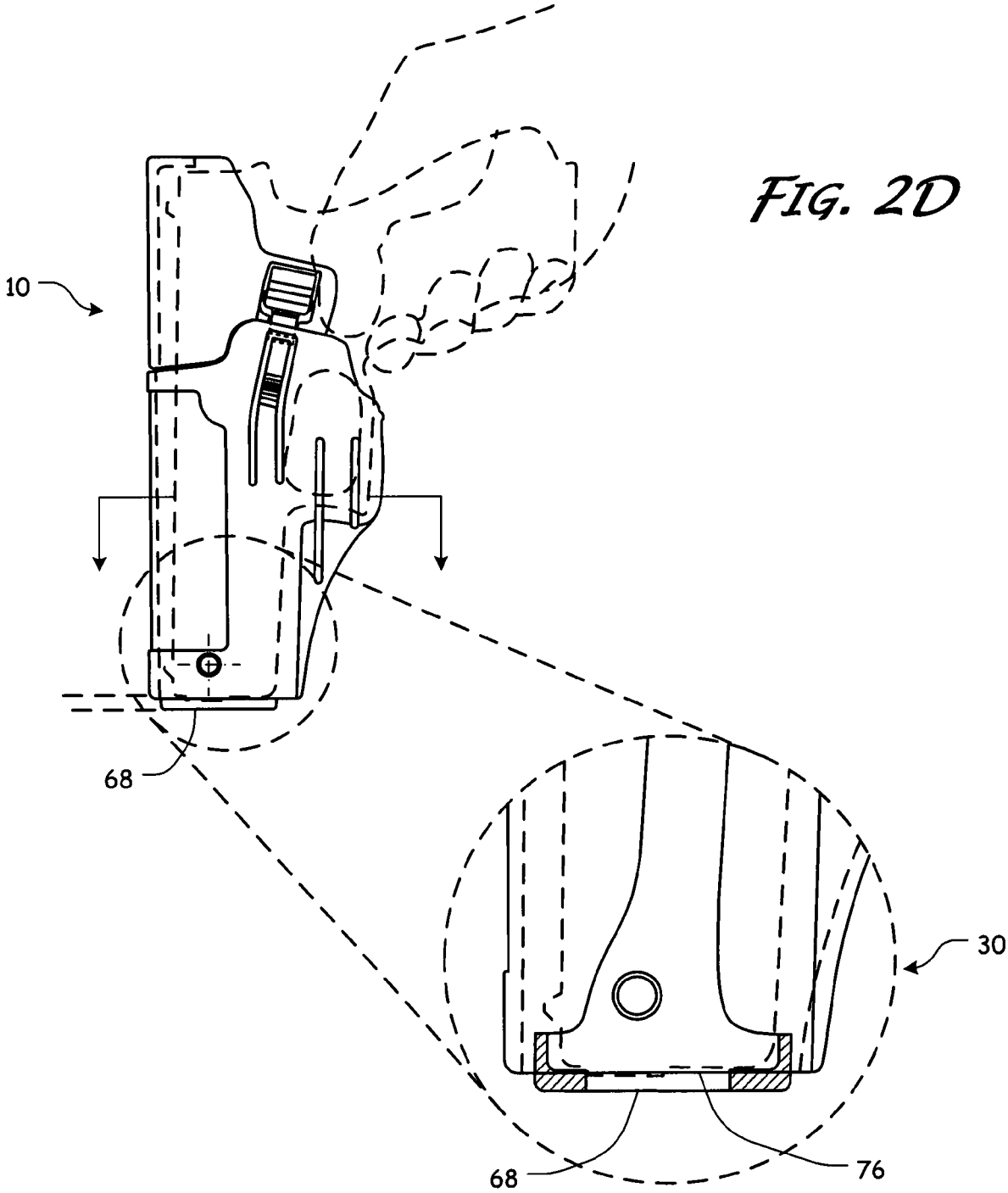
FIG. 2D is a side elevation view of the holster of FIG. 2C immediately following holstering of the weapon, including those portions of the weapon which are not visible and a user's hand in phantom.

FIG. 2C shows the beginning of the reholstering motion. The pivot plate 68 is pivoted such that the retaining hood is in the open position. The handgun is inserted into the cavity formed by the body and the open retaining hood. Then, the pivot plate 68 is engaged by the front face 76 of the handgun. As discussed above, when the front face of the gun is in a position to engage the pivot plate, the rear face 78 of the gun is in a position that allows the retaining hood to close over it. The handgun and holster thus return to the closed configuration as is shown in FIG. 2D.

Figure 3A:
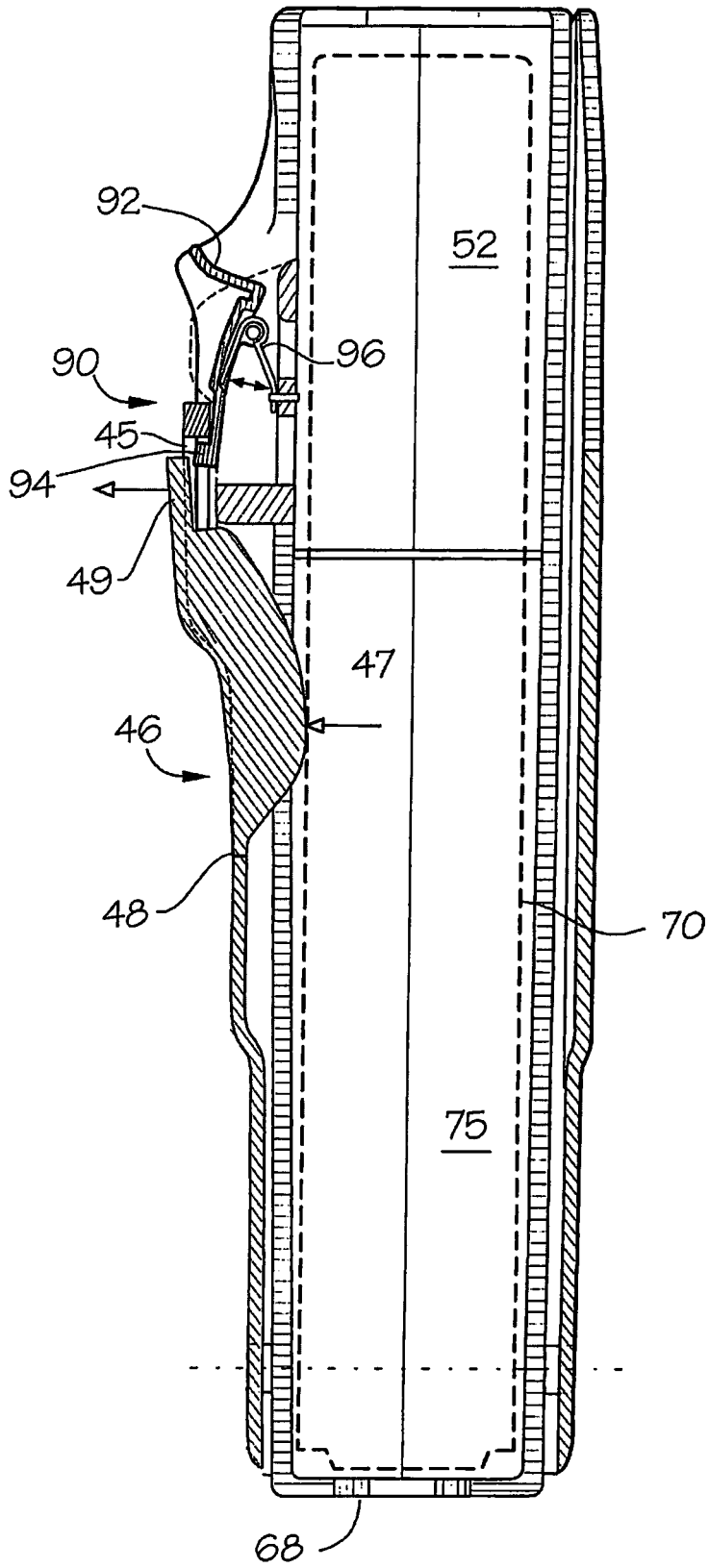
FIG. 3A is a rear cross-sectional view of a holster in accordance with the present invention taken along the line 3-3 of FIG. 2A, including a holstered weapon shown in phantom.

Turning now to the operation of the lock mechanism, FIG. 3A is a rear elevation cross-sectional view taken along the line 3-3 of FIG. 2A. Locking plate 46 includes protruding ridge 47 on its inner surface. When the handgun 70 is secured within the holster, the barrel 75 of the weapon urges the locking plate to an outward position by contact with the protruding ridge. Specifically, the locking plate assumes a slight outward bend at bend point 48. This outward bend is slight but sufficient to remove free end 49 of the locking plate from the plane of the body side wall. With free end 49 removed, locking tab 94 is caught by the recess 45 formed by groove 44 and the tops of grooves 40 and 42. Thus, looking specifically at FIG. 3A, thumb release 90 includes thumb engagement surface 92 and locking tab 94. Locking spring 96 biases the locking tab 94 forward to a locking position. Accordingly, when the handgun is in the holster, the locking plate 46 is bent outwardly and the locking tab 94, which is carried on the retaining hood 52, is caught in the recess 45, which is defined in the body side wall. The hood assembly is thereby locked to the body.

In order to remove the handgun from the holster the thumb release is depressed and the locking tab is pivotably pulled from the recess 45. As is shown in FIG. 3B, the locking plate 46 is still bent outwardly at this point because the barrel of the handgun is still pressing against the protruding ridge 47. At this point, the upholstering action depends on the holster embodiment employed. As discussed above, it is preferred that the hood is biased to an open position when the lock mechanism is disengaged such as by a spring loaded mechanism, such as is illustrated in and discussed with respect to FIGS. 4A-4D, below. If that preferred embodiment is employed, then the hood assembly will automatically pivot to the open position with the motion of the pivot plate 68 urging the handgun upwardly. If such preferred embodiment is not employed, the retaining hood must be pressed forward concurrently with depression of the thumb release.

Regardless of the means for opening the retaining hood, as the weapon is removed the locking plate 46 relaxes to a position coplanar with the surrounding body side wall 22. As is shown in FIG. 3C, the free end 49 of the plate seats in recess 45. Retaining hood 52 has been pivoted to its forward open position and locking tab 94 is held back by the inner surface of the body side wall 22. It should be noted that, although it appears in FIG. 3C that the locking tab is abutting the free end 49 of the locking plate, it has actually been pivoted forward and is resting against the inner surface of the body side wall.

FIGS. 4A-4D illustrate an exemplary embodiment of the spring loaded mechanism in accordance with the present invention for biasing the hood assembly to the open position. FIG. 4A is a cross-sectional view taken from the inside of the holster looking toward the inner surface of side wall 24 of the body. Spring 98 is carried in recess 99 defined in the inner surface of side wall 24 and presses against pivot arm 64. FIG. 4B is a cross-sectional view taken in the opposite direction with spring 98' pressing against pivot arm 62. Although a weapon is not shown, both FIGS. 4A and 4B show the spring in the compressed, holstered position with the hood assembly closed. FIG. 4C shows the hood assembly biased to the open position by spring 98'. The seating of the spring in recess 99' is shown in the rear sectional view of FIG. 4D.

Figure 5A:
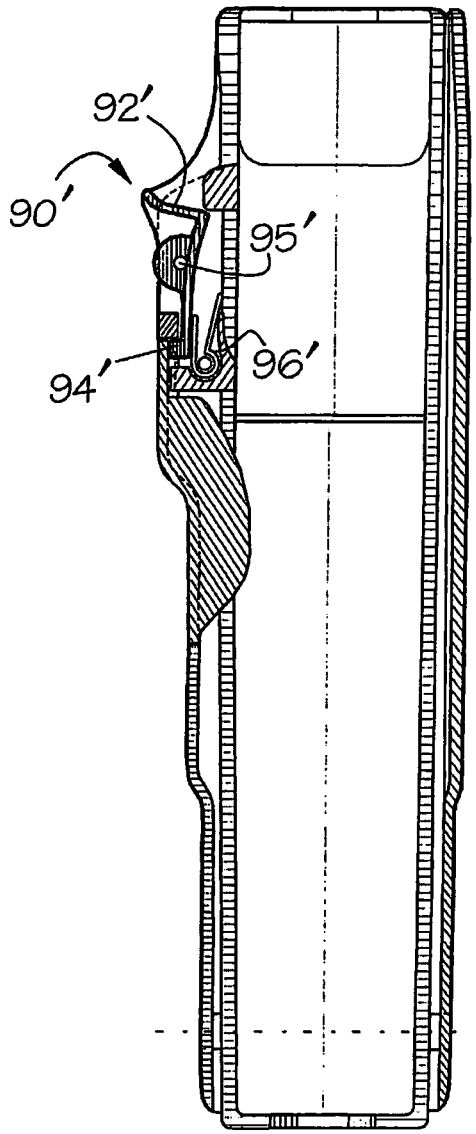
FIG. 5A is a rear cross-sectional view of a holster in accordance with the present invention, without a weapon, including an alternative embodiment of a lock mechanism.
Figure 5B:
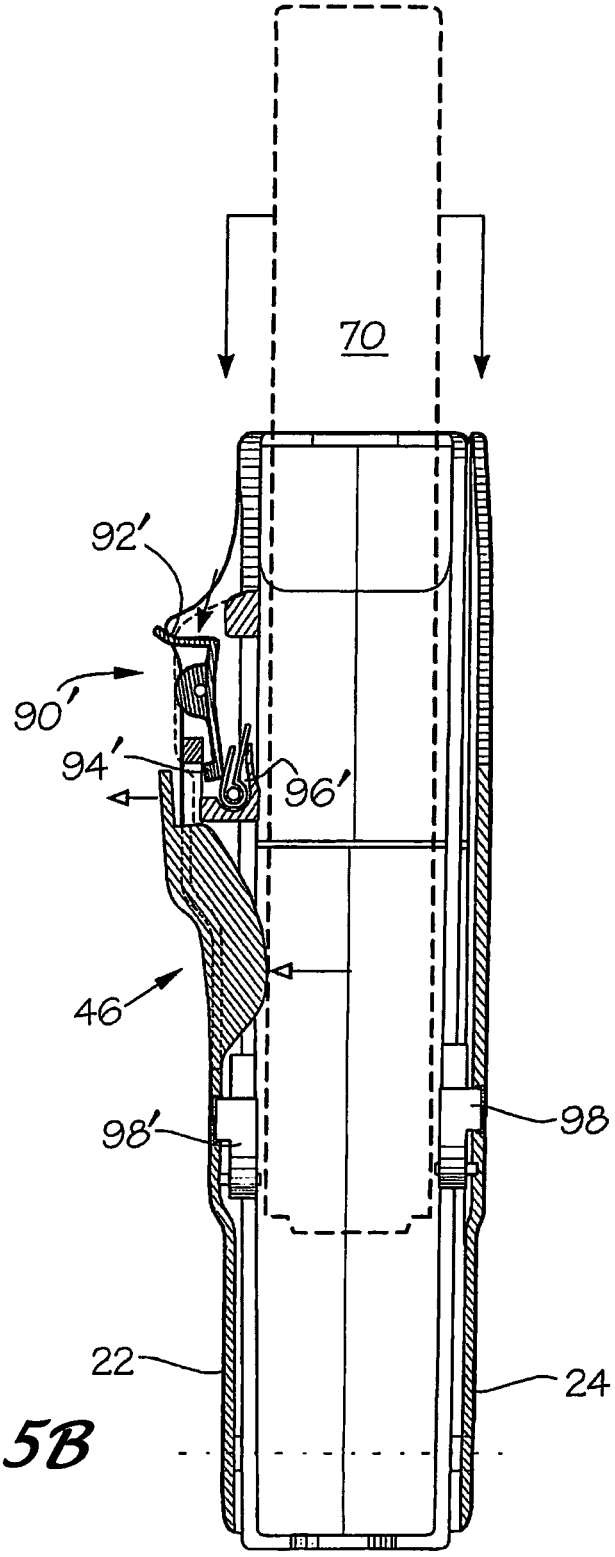
FIG. 5B is a rear cross-sectional view of the holster shown in FIG. 5A during holstering of the weapon.

FIGS. 5A and 5B show similar front elevation cross-sectional views of a holster in accordance with the present invention with an alternative thumb release structure. The thumb release 90' of FIGS. 5A and 5B include a similar thumb engagement surface 92' and locking tab 94' but a different pivot point 95' and a locking spring 96' in an alternative position. The means of operation, however, is the same as discussed above with respect to FIGS. 3A-3C. Also shown in FIG. 5B are springs 98 and 98' seated in recesses 99 and 99', respectively.

Figure 6:
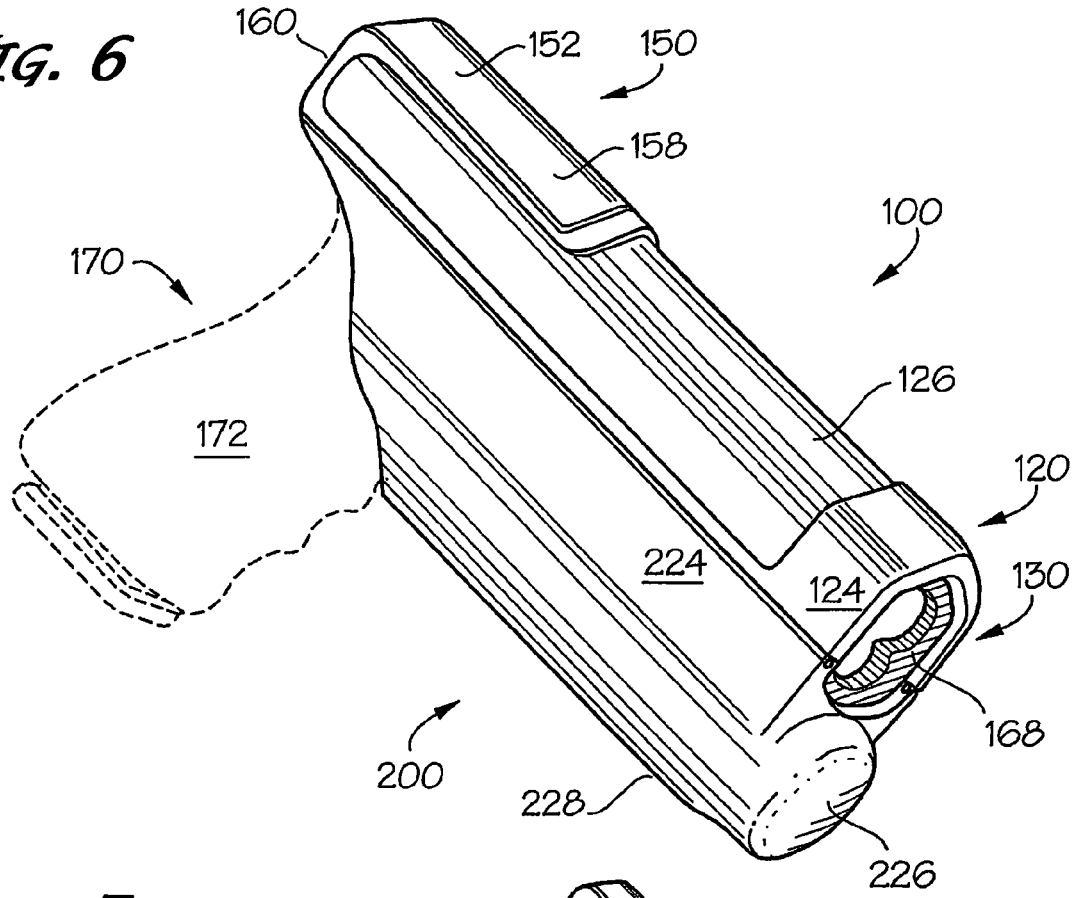
FIG. 6 is a perspective view of a holster in accordance with the present invention with a cup for accommodating a weapon accessory, the grip of the weapon shown in phantom.
Figure 7:
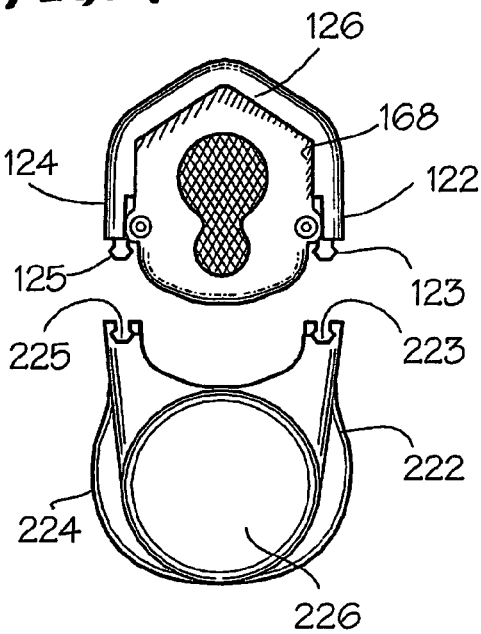
FIG. 7 is a bottom plan view of the holster of FIG. 6 with the cup removed from the holster.
Figure 8:
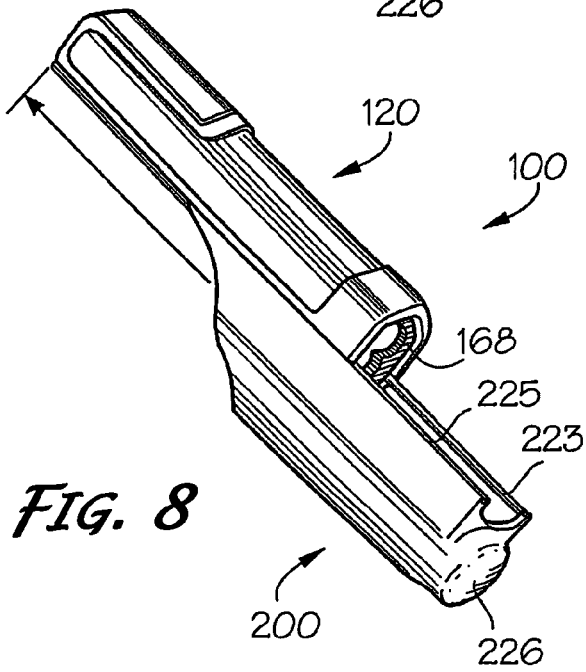
FIG. 8 is a perspective view of the holster of FIG. 7 with the cup being replaced onto the holster.

FIGS. 6-8 illustrate an alternative feature of the present inventive holster. Looking at FIG. 6, holster 100 includes a body 120 having a first side wall 122, a second side wall 124, a front wall 126, and a lower portion 130. Attachment points are on a portion of the first side wall 122 of the body, which is not visible in this view. The holster further includes a hood assembly 150 including a retaining hood 152 having a first side wall (not visible in this view), a second side wall 156, a front wall 158, and a top wall 160. The thumb release of the locking mechanism is on the first side wall of the hood head and is, therefore, not visible in this view. The pivot arms of the hood are also not shown; but pivot plate 168 is visible at the lower portion 130 of the body. The grip 172 of a handgun 170 is shown in phantom. Thus, holster 100 is, in many ways, substantially similar to the holster described above with respect to FIGS. 3 and 5. However, the side walls 122 and 124 of the present embodiment are truncated and a rear wall is not provided. Instead, tracks 123 and 125 are provided for carrying a removable, replaceable, interchangeable rear cup 200. Rear cup 200 includes a first side wall 222, a second side wall 224, a bottom wall 226, and a rear wall 228. Channels 223 and 225 of the rear cup slide onto tracks 123 and 125, respectively. Thus, the cup may be fastened onto the body by aligning the rear cup channels with the body side wall tracks as is shown in FIG. 8.

FIGS. 9A-12B illustrate a further holster 300 in accordance with the present invention. Looking first at FIG. 9A, holster 300 includes body 320 having first side wall 322, second side wall 324 (not seen in this view), front wall 326, lower portion 330, and attachment point 332. Holster hood assembly 350 includes retaining hood 352 having first side wall 354, second side wall 356 (not seen in this view), front wall 358, top wall 360, and pivot stud 366. Handgun 370 includes grip 372, trigger guard 374, barrel 375, front face 376, rear face 378, front sight 380, rear sight 382, and laser sighting accessory 384.

Thus, holster 300 further includes removable, replaceable, interchangeable rear cup 400 to accommodate the weapon's accessory. Rear cup 400 includes first side wall 422, a second side wall (not seen in this view), a bottom wall 426, and a rear wall 428. In the present embodiment, rails on the inner surfaces of the rear cup side walls (not shown) mate with channels on outer surfaces of the body side walls to slidably position the rear cup onto the body. Channel 323 on side wall 322 can be seen in FIG. 9B. In addition to the rear cup rails carried in the body side wall channels, the present embodiment further employs a cup tab, which protrudes inwardly at 430 and is received in recess 332, thereby locking the cup onto the body. Alternative means of securing the cup onto the holster body include a variety of fasteners such as screws and the like.

Figure 9A:
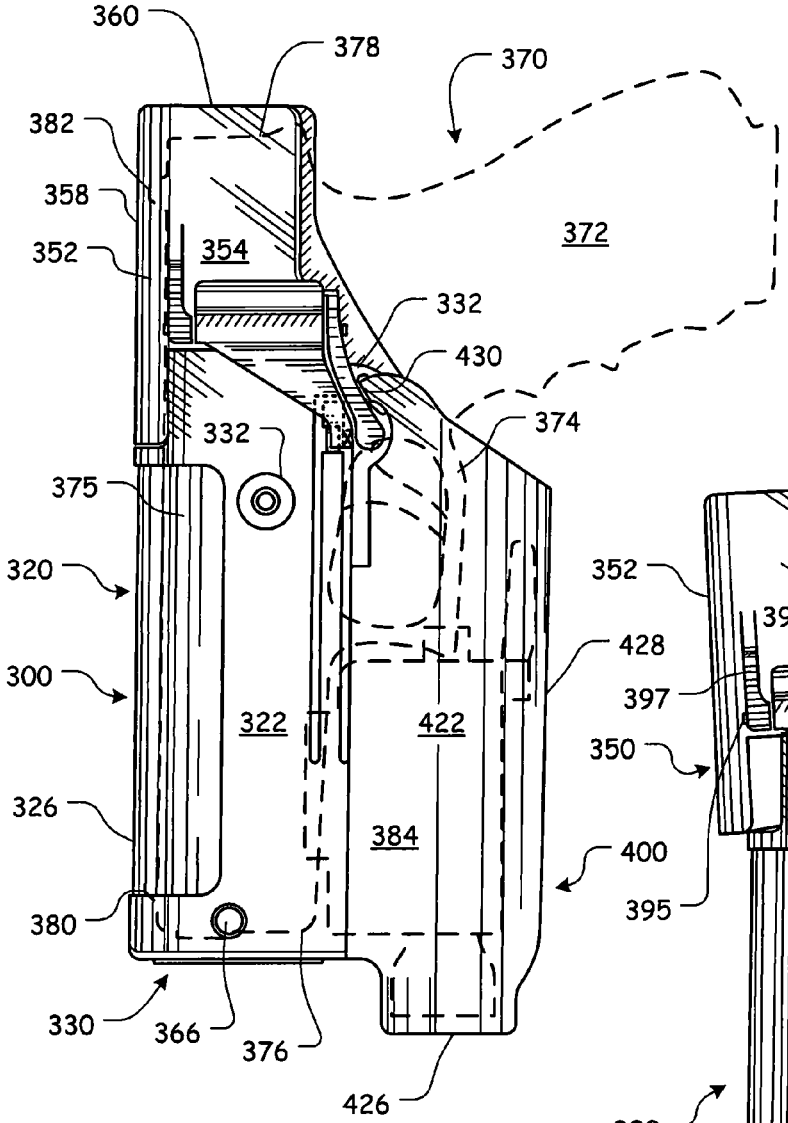
FIG. 9A is a side elevation view of a holster in accordance with the present invention including a cup for accommodating a weapon accessory and yet another lock mechanism, with the weapon and accessory shown in phantom.
Figure 9B:
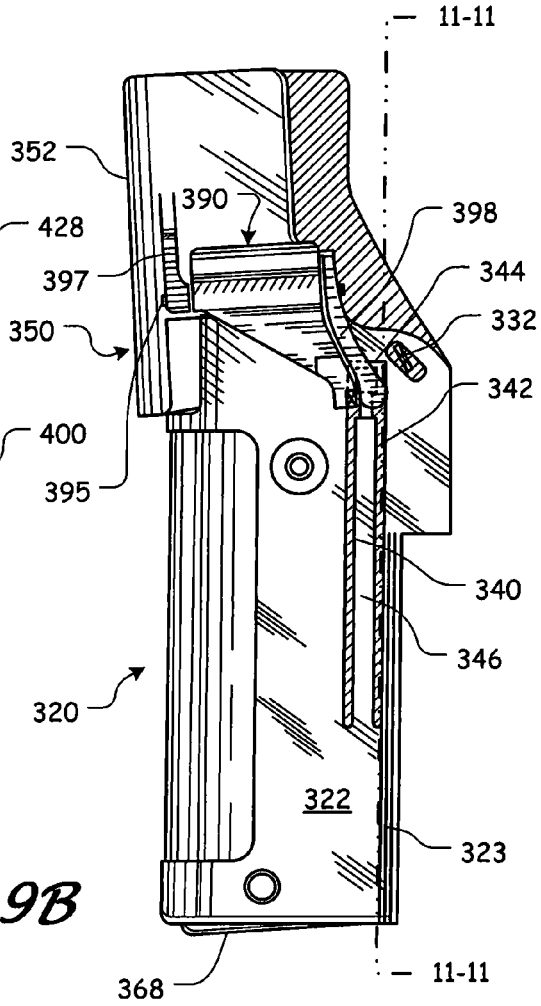
FIG. 9B is a side elevation view of the holster of FIG. 9A with the accessory cup removed and with the hood assembly in an open position.

In addition to presenting an alternative rear cup assembly, FIGS. 9A and 9B further present an alternative locking and thumb release mechanism. Looking specifically to FIG. 9B, body 320 includes a locking plate 346 defined by grooves 340, 342 and 344. Retaining hood 352 includes thumb release 390 having thumb engagement surface 392, locking tab 394 (not seen in this view), and pivot pin 395. The thumb release of the present embodiment further defines front and rear side walls, 397 and 398, respectively, which protrude outwardly from retaining hood side wall 354, protecting the thumb release structure and providing the pivot point for pivot pin 395.

Figure 10:
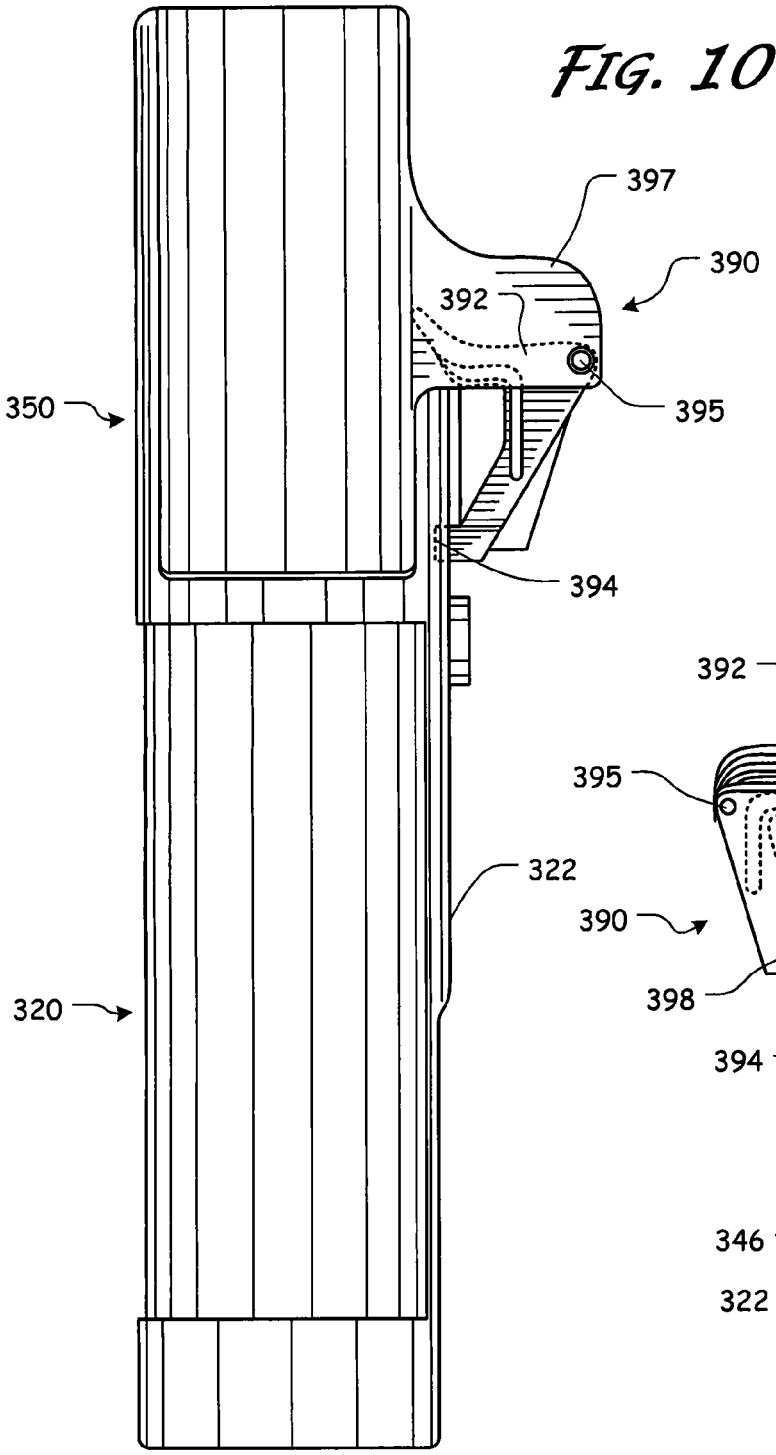
FIG. 10 is a front elevation view of the holster of FIG. 9B.
Figure 11:
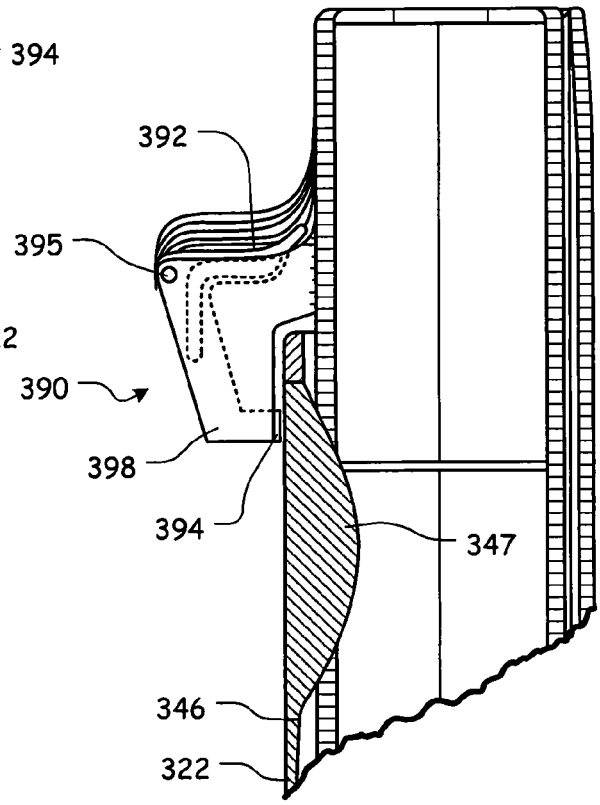
FIG. 11 is a rear cross-sectional view of the holster of FIG. 9A taken along the line 11-11 of FIG. 9B, with portions of the lock mechanism shown in phantom.

While the thumb release components are readily seen in the front elevation view of FIG. 10 (with thumb engagement surface 392 and locking tab 394 shown in phantom), the interaction of the thumb release with the locking plate 346 is better seen in FIG. 11. Specifically, FIG. 11 is taken along the line 11-11 of FIG. 9B. That view shows the body and hood assembly of holster 300 with the hood assembly in the open position. Thus, in FIG. 11, protruding ridge 347 of locking plate 346 is in a relaxed position. Since the hood assembly is pivoted forwardly, locking tab 394 of the thumb release rests against the outer surface of body side wall 322, forward of the locking plate. FIG. 11 is somewhat deceptive in that it appears that the locking tab 394 is resting against the outer surface of locking plate 346. However, as can be seen in FIG. 9B, with the hood assembly in the open position, locking tab 394 is forward of the locking plate. Instead, the lower portion of rear side wall 398 is positioned above and adjacent to the free end 349 of locking plate 346.

FIG. 12A shows the present embodiment of the locking mechanism in its engaged position. Locking tab 394 is caught behind the free end 349 of locking plate 346. Thus, whereas the locking tabs discussed above with respect to FIGS. 3 and 5 were positioned inside the holster body and were locked by being caught in a recess formed in the body side wall by protrusion of the locking plate, the present locking tab is outside of the holster body and is locked by being caught behind the rear surface of the free end of the outwardly protruding locking plate.

FIG. 12B shows the initiation of the unholstering motion for this embodiment. Downward pressure on the thumb engagement surface 392 allows the locking tab 394 to swing out past the locking plate. The retaining hood is then pushed forwardly, either automatically or manually, as discussed above with respect to other embodiments. The forward motion of the retaining hood pivots the pivot plate and lifts the gun.

It should be noted that only a few lock mechanisms in accordance with the present invention have been discussed in the present description. A variety of other configurations may be employed, including, for example, finger activated rather than thumb activated releases.

Similarly, only a few means for providing interchangeable rear cups in accordance with the present invention have been presented. However, any means for removably, yet securely fastening a cup for accommodating a given accessory onto the present inventive holster may be employed.

Likewise, a variety of means for biasing the hood assembly to the open position when a weapon is absent from the holster may be employed.

Preferred embodiments of the invention have been described using specific terms and devices. The words and terms used are for illustrative purposes only. The words and terms are words and terms of description, rather than of limitation. It is to be understood that changes and variations may be made by those of ordinary skill art without departing from the spirit or scope of the invention, which is set forth in the following claims. In addition, it should be understood that aspects of the various embodiments may be interchanged in whole or in part. Therefore, the spirit and scope of the appended claims should not be limited to descriptions and examples herein.

Figure 13:
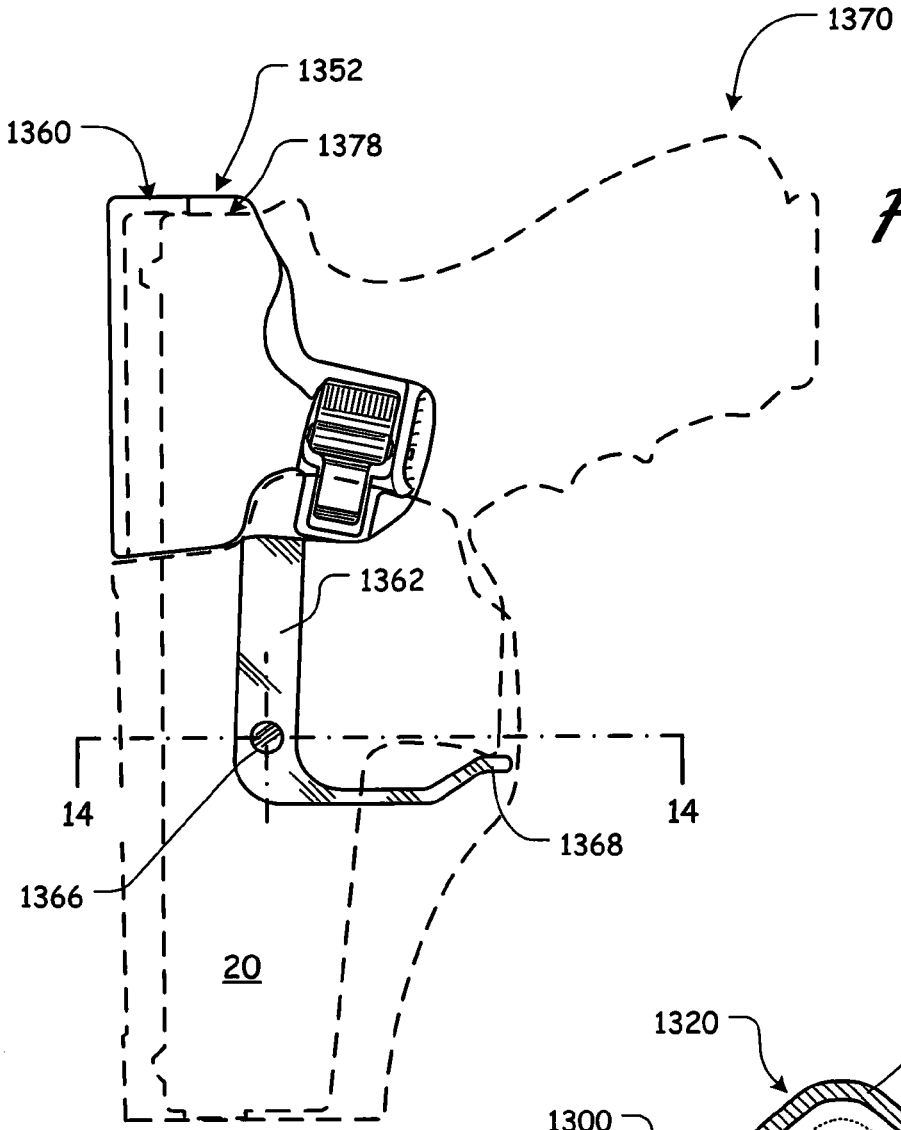
FIG. 13 is an elevational side view of another exemplary embodiment of a holster, according to this invention.
Figure 14:
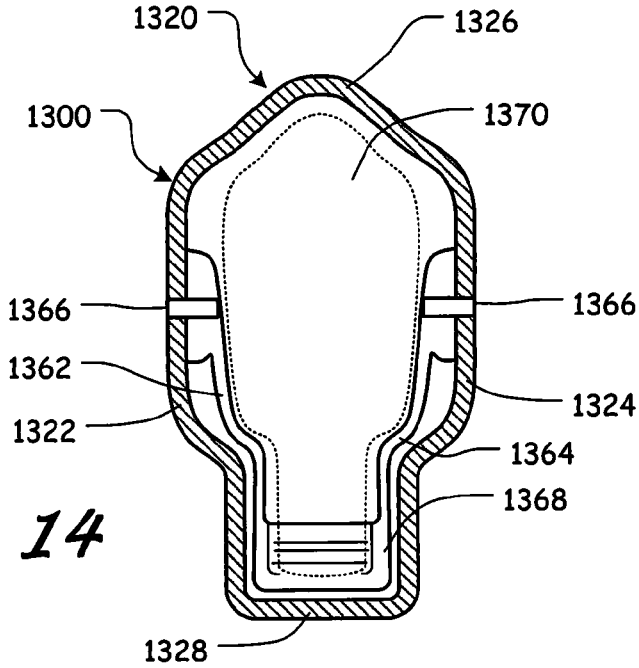
FIG. 14 is a top, cross-sectional view of the holster of FIG. 13.

FIG. 13 shows an elevational side view of an exemplary embodiment of a holster 1300, while FIG. 14 shows a top, cross-sectional view taken along line 14-14 of the holster 1300 according to this invention. As illustrated in FIGS. 13 and 14, the holster 1300 corresponds to and operates similarly to the holster(s) as described above with reference to FIGS. 1-12B. However, as shown in FIGS. 13 and 14, the holster 1300 includes at least some of a body 1320 that defines a weapon-receiving cavity and includes a first side wall 1322, a second side wall 1324, a front wall 1326, and a rear wall 1328. The holster 1300 also includes some of a retaining hood 1352 having a first side wall 1354, a second side wall (not seen in this view), a front wall 1358, and a top wall 1360, one or more pivot arms 1362 and/or 1364, a pivot plate 1368, and pivot stud(s) 1366. As illustrated, the pivot plate 1368 is positioned so as to be engaged by the front face of the handgun's trigger guard as opposed to the front face of the handgun 1370.

Thus, during the holstering of the handgun, as the handgun 1370 is inserted into the cavity formed by the body and the open retaining hood, the pivot plate 1368 is engaged by the front face of the handgun's trigger guard. As the handgun 1370 continues to be inserted in to the holster 1300, the front face of the trigger guard continues to contact the pivot plate 1368 as the rear face 1378 of the handgun 1370 is in move into a position that allows the retaining hood 1350 to close over the rear face 1378 of the handgun 1370, such that the holster 1300 is returned to a closed configuration.

It should be appreciated that the motion of un-holstering the handgun 1370 is as described above with reference to FIGS. 1-12B.

Figure 15:
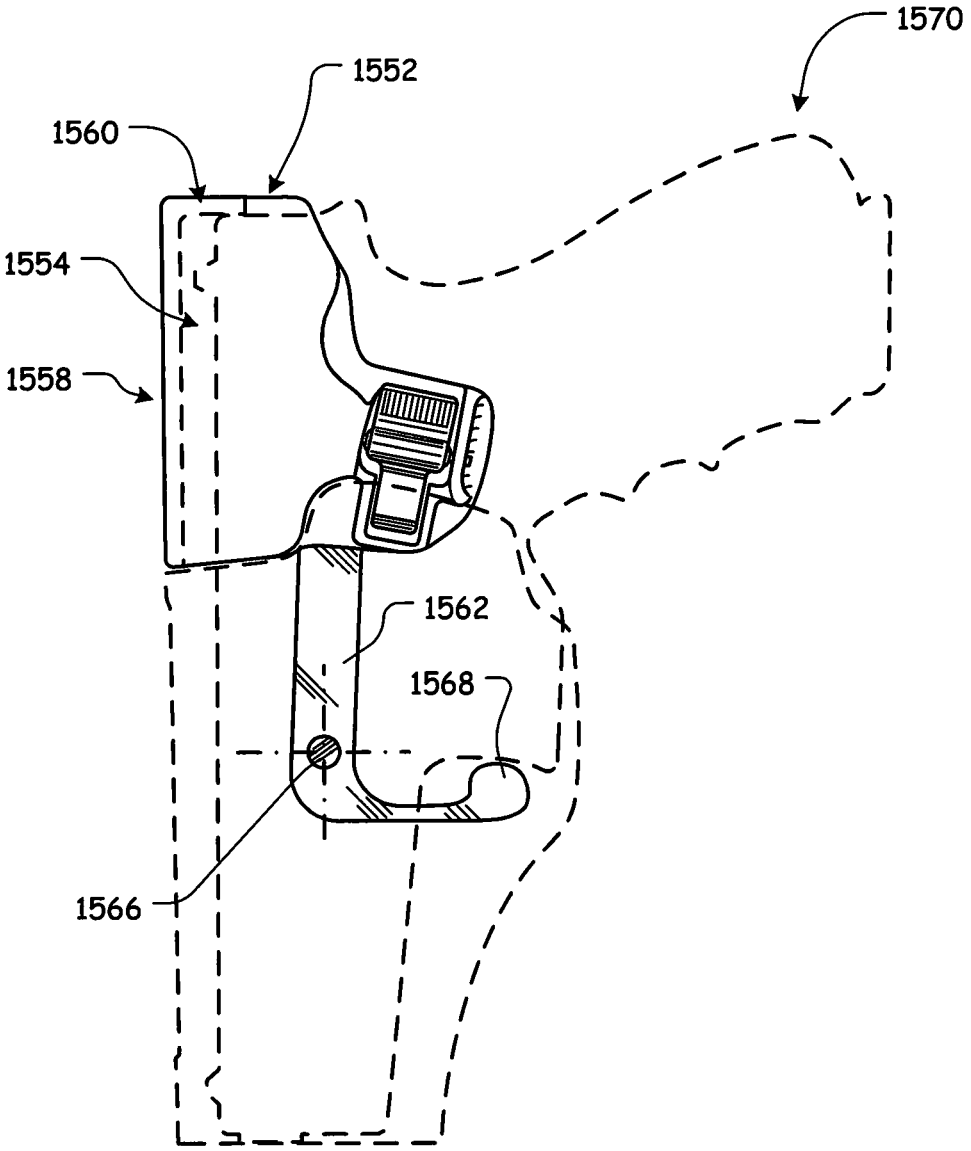
FIG. 15 is a side elevation view of a holster illustrating a modified embodiment of the holster of FIG. 13, including those portions of the weapon that are not visible and a user's hand in phantom.

FIG. 15 shows a side elevation view of a holster illustrating a modified embodiment of the holster 1300 of FIG. 13. As shown in FIG. 15, the holster 1500 includes some of a retaining hood 1552 having a first side wall 1554, a second side wall (not seen in this view), a front wall 1558, and a top wall 1560, one or more pivot arms 1562, a pivot plate 1568, and pivot stud(s) 1566. As further illustrated in FIG. 15, the pivot plate 1568 of holster 1500 is contoured so as to make contact with the front face of the trigger guard of the handgun 1570.

It should be appreciated that the overall size, shape, and placement of the pivot plate 1368 or 1568 is a design choice based upon the desired point and/or amount of contact between the pivot plate and the handgun's trigger guard. The overall size, shape, and placement of the pivot plate may also be dictated by the size and or shape of the handgun that is to be inserted within the holster.

While this invention has been described in conjunction with the exemplary embodiments outlined above, it is evident that many alternatives, modifications, and variations will be apparent to those skilled in the art. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A holster, comprising:

a body defining a cavity for receiving at least a portion of a weapon, said body comprising a pair of opposed side walls;

a hood assembly pivotably connected to said body, wherein said hood assembly is pivotable between an open position and a closed position;

a lock mechanism for maintaining said hood assembly in said closed position;

a finger/thumb release associated with said lock mechanism for releasing said hood assembly from said closed position; and at least one pivot arm that extends from said hood assembly to a pivot plate, wherein said pivot plate automatically pivots said hood assembly to said closed position such that said lock mechanism is automatically engaged as a forward face of a trigger guard of an inserted weapon urges said pivot plate.

2. The holster of claim 1, wherein said hood assembly is biased to said open position when a weapon is absent from said body.

3. The holster of claim 1, wherein said hood assembly is biased to said open position by a spring.

4. The holster of claim 1, wherein said lock mechanism is precluded from engaging when a weapon is absent from said body.

5. The holster of claim 1, wherein a portion of said body comprises a removable, replaceable, interchangeable cup for accommodating an accessory for a received weapon.

6. The holster of claim 1, wherein said pivot arm extends, along said interior of one of said opposed side walls, from said hood assembly to said pivot plate.

7. The holster of claim 1, wherein said pivot arm extends, along an interior portion of one of said opposed side walls, from said hood assembly to said pivot plate.

8. The holster of claim 1, wherein said hood assembly is pivotably attached at a point on said pivot arm adjacent to said pivot plate to a point on said body adjacent to said lower portion of said body.

9. The holster of claim 1, wherein a pair of elongated pivot arms extend from said hood assembly to said pivot plate.

10. The holster of claim 1, wherein said pivot plate automatically pivots said hood assembly to said closed position such that said lock mechanism is automatically engaged if a forward face of a trigger guard of an inserted weapon engages and urges said pivot plate a determined distance.

11. The holster of claim 1, wherein said finger/thumb release comprises a thumb release.

12. The holster of claim 1, wherein said finger/thumb release comprises a finger release.

13. The holster of claim 1, wherein said lock mechanism is biased to an engaged position when said weapon is held in said body cavity.

14. A holster, comprising:

a body defining a cavity for receiving at least a portion of a weapon, said body comprising a pair of opposed side walls;

a hood assembly pivotably connected to said body, said hood assembly comprising a retaining hood and at least one elongated pivot arm that extends from said retaining hood to a pivot plate, wherein said hood assembly is pivotable between a closed position and an open position, wherein said hood assembly is biased to said open position when a weapon is absent from said body, and wherein said hood assembly automatically pivots to said closed position as a weapon is inserted into said body cavity;

a lock mechanism that maintains said hood assembly in said closed position when at least a portion of a weapon is received in said body cavity, wherein said lock mechanism is biased to an engaged position when at least a portion of a weapon is received in said body cavity; and a finger/thumb release associated with said lock mechanism for releasing said hood assembly from said closed position for removal of said weapon.

15. The holster of claim 14, wherein said hood assembly is biased to said open position by a spring.

16. The holster of claim 14, wherein said lock mechanism is precluded from engaging when a weapon is absent from said body.

17. The holster of claim 14, wherein a portion of said body comprises a removable, replaceable, interchangeable cup for accommodating an accessory for a received weapon.

18. The holster of claim 14, wherein said hood assembly comprises a pair of elongated pivot arms.

19. A holster, comprising:

a body defining a cavity for receiving at least a portion of a weapon, said body comprising a pair of opposed side walls;

a hood assembly pivotably connected to said body, wherein said hood assembly is pivotable between a closed position for securing said weapon within said body cavity and an open position for insertion or removal of said weapon;

a lock mechanism for maintaining said hood assembly in said closed position when a weapon is held in said body cavity;

a finger/thumb release associated with said lock mechanism for releasing said hood assembly to pivot to said open position; and at least one pivot arm that extends from said hood assembly to a pivot plate for automatically pivoting said hood assembly to said closed position and automatically engaging said lock mechanism as at least a portion of said weapon is inserted into said body cavity, wherein said pivot plate is positioned to engage a front face of said weapon's trigger guard as said weapon is inserted into said body cavity.

* * * * *

UNITED STATES PATENT AND TRADEMARK OFFICE

CERTIFICATE OF CORRECTION

PATENT NO. : 8,517,235 B1
APPLICATION NO. : 13/446273
DATED : August 27, 2013
INVENTOR(S) : Kincaid et al.

It is certified that error appears in the above-identified patent and that said Letters Patent is hereby corrected as shown below:

On the title page item [57], in the Abstract, Line 11-12 delete "such that to the lock mechanism" and insert --such that the lock mechanism--.

In the Specification

Column 6, Line 21, delete "interior of the body side walls. Alternatively, the pivot aims 62" and insert --interior of the body side walls. Alternatively, the pivot arms 62--.

Column 7, Line 57, delete "at this point, the upholstering action depends on the holster" and insert --at this point, the unholstering action depends on the holster--.

Signed and Sealed this
Twenty-fifth Day of February, 2014

Michelle K. Lee

Michelle K. Lee
*Deputy Director of the United States Patent and Trademark Office*